US011396196B2

(12) United States Patent
Hart et al.

(10) Patent No.: US 11,396,196 B2
(45) Date of Patent: Jul. 26, 2022

(54) APPARATUS AND METHODS FOR CONTACT-PRINTING USING ELECTROSTATIC NANOPOROUS STAMPS

(71) Applicant: Massachusetts Institute of Technology, Cambridge, MA (US)

(72) Inventors: Anastasios John Hart, Waban, MA (US); Sanha Kim, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 16 days.

(21) Appl. No.: 16/959,721

(22) PCT Filed: Jan. 5, 2018

(86) PCT No.: PCT/US2018/012509
§ 371 (c)(1),
(2) Date: Jul. 2, 2020

(87) PCT Pub. No.: WO2019/135757
PCT Pub. Date: Jul. 11, 2019

(65) Prior Publication Data
US 2020/0346476 A1 Nov. 5, 2020

(51) Int. Cl.
*B41N 1/12* (2006.01)
*B41M 1/04* (2006.01)
*B41M 1/42* (2006.01)

(52) U.S. Cl.
CPC ..... *B41M 1/42* (2013.01); *B41M 1/04* (2013.01); *B41N 1/12* (2013.01)

(58) Field of Classification Search
None
See application file for complete search history.

(56) References Cited

U.S. PATENT DOCUMENTS

| | | | |
|---|---|---|---|
| 6,866,801 | B1 | 3/2005 | Mau et al. |
| 7,521,292 | B2 | 4/2009 | Rogers et al. |
| 7,531,120 | B2 | 5/2009 | Van Rijn et al. |
| 7,951,424 | B2 | 5/2011 | Afzali-Ardakani et al. |
| 8,027,086 | B2 | 9/2011 | Guo et al. |
| 8,950,324 | B2 | 2/2015 | Berniard et al. |

(Continued)

OTHER PUBLICATIONS

Invitation to Pay Additional Fees dated Mar. 12, 2018 for Application No. PCT/US2018/012509.

(Continued)

*Primary Examiner* — Joshua D Zimmerman
(74) *Attorney, Agent, or Firm* — Wolf, Greenfield & Sacks, P.C.

(57) ABSTRACT

Methods and apparatus for contacting printing via electrostatic force. In one example, an apparatus for contact printing using an ink includes a substrate, a conductive layer disposed on the substrate, and a group of microstructures disposed on the conductive layer. Each microstructure includes a group of conductive porous medium extending from the conductive layer. The apparatus also includes a dielectric layer conformally disposed on the microstructures and configured to electrically insulate the microstructures from the ink during use. The conductive layer is configured to apply a voltage on the group of microstructures to facilitate the loading and dispensing of ink.

29 Claims, 9 Drawing Sheets

(56) References Cited

U.S. PATENT DOCUMENTS

| | | | | |
|---|---|---|---|---|
| 8,991,314 | B2 | 3/2015 | Cheng et al. | |
| 9,073,759 | B2 | 7/2015 | Zeng et al. | |
| 10,118,426 | B2 | 11/2018 | Hart et al. | |
| 10,583,677 | B2 | 3/2020 | Hart et al. | |
| 2004/0028875 | A1 | 2/2004 | Van Rijn et al. | |
| 2006/0103694 | A1 | 5/2006 | Nguyen | |
| 2007/0076084 | A1* | 4/2007 | Iftime | B41N 1/06 347/111 |
| 2011/0204020 | A1 | 8/2011 | Ray et al. | |
| 2011/0248315 | A1 | 10/2011 | Nam et al. | |
| 2014/0120419 | A1* | 5/2014 | Pushparaj | H01M 4/133 429/211 |
| 2014/0329054 | A1 | 11/2014 | Theivanayagam Chairman et al. | |
| 2016/0152059 | A1* | 6/2016 | Hart | G03F 7/0015 101/333 |

OTHER PUBLICATIONS

International Search Report and Written Opinion dated May 7, 2018 for Application No. PCT/US2018/012509.

Gabay et al., Electro-chemical and Biological Properties of Carbon Nanotube Based Multi-Electrode Arrays. Nanotechnology. Jan. 24, 2007;18(3):035201. doi: 10.1088/0957-4484/18/3/035201. Epub Jan. 3, 2007.

Kim et al., Ultrathin High-Resolution Flexographic Printing Using Nanoporous Stamps. Sci Adv. Dec. 7, 2016;2(12):el601660. doi: 10.1126/sciadv.1601660. eCollection Dec. 2016.

Ahn et al., Transparent conductive grids via direct writing of silver nanoparticle inks. Nanoscale. Jul. 2011;3(7):2700-2. doi: 10.1039/c1nr10048c. EpubApr. 13, 2011.

Ahn et al., Omnidirectional printing of flexible, stretchable, and spanning silver microelectrodes. Science. Mar. 20, 2009;323(5921): 1590-3. doi: 10.1126/science. 1168375. Epub Feb. 12, 2009.

Bae et al., Roll-to-roll production of 30-inch graphene films for transparent electrodes. Nat Nanotechnol. Aug. 2010;5(8):574-8. doi: 10.1038/nnano.2010.132. Epub Jun. 20, 2010.

Barnes et al., Comparing the fundamental physics and device performance of transparent, conductive nanostructured networks with conventional transparent conducting oxides. Adv. Energy Mater. 2012;2:353-60.

Basnar et al., Dip-pen-nanolithographic patterning of metallic, semiconductor, and metal oxide nanostructures on surfaces. Small. Jan. 2009;5(1):28-44. doi: 10.1002/smll.200800583.

Bedewy et al., Population growth dynamics of carbon nanotubes. ACS Nano. Nov. 22, 2011;5(11):8974-89. doi: 10.1021/nn203144f. Epub Oct. 23, 2011.

Bedewy et al., Synergetic chemical coupling controls the uniformity of carbon nanotube microstructure growth. ACS Nano. Jun. 24, 2014;8(6):5799-812. doi: 10.1021/nn500698z. Epub May 3, 2014.

Bedewy et al., Collective mechanism for the evolution and self-termination of vertically aligned carbon nanotube growth. J. Phys. Chem. C. 2009;113:20576-82. Epub Oct. 29, 2009.

Bradford et al., Tuning the compressive mechanical properties of carbon nanotube foam. Carbon. 2011;49:2834-41.

Brieland-Shoultz et al., Scaling the stiffness, strength, and toughness of ceramic-coated nanotube foams into the structural regime. Adv Funct Mater. 2014;24:5728-35.

Cao et al., Super-compressible foamlike carbon nanotube films. Science. Nov. 25, 2005;310(5752):1307-10.

Carlson et al., Transfer printing techniques for materials assembly and micro/nanodevice fabrication. Adv Mater. Oct. 9, 2012;24(39):5284-318. doi: 10.1002/adma.201201386. Epub Aug. 31, 2012.

Chen et al., Oxygen functionalization of multiwall carbon nanotubes by microwave-excited surface-wave plasma treatment. J. Phys. Chem. C. 2009;113(18):7659-65. Epub Apr. 14, 2009.

Deganello et al., Patterning of micro-scale conductive networks using reel-to-reel flexographic printing. Thin Solid Films. 2010; 518:6113-6. Epub Jun. 4, 2010.

Derby, Inkjet printing of functional and structural materials: Fluid property requirements, feature stability, and resolution. Annu. Rev. Mater. Res. 2010;40:395-414. Epub Mar. 9, 2010.

De Voider et al., Fabrication and electrical integration of robust carbon nanotube micropillars by self-directed elastocapillary densification. J. Micromech. Microeng. 2011;21:045033(1-12).

De Voider et al., Engineering hierarchical nanostructures by elastocapillary self-assembly. Angew. Chem. Intl. Ed. 2013;52:2412-25.

De Voider et al., Diverse 3D microarchitectures made by capillary forming of carbon nanotubes. Adv. Mater. 2010;22:4384-9.

Down et al., Investigating the benefits of a compliant gold coated multi-walled carbon nanotube contact surface in micro-electro mechanical systems switching. Appl. Phys. Lett. 2015;107:071901(1-4). Epub Aug. 17, 2015.

Ellmer, Past achievements and future challenges in the development of optically transparent electrodes. Nat. Photonics. Dec. 2012;6:809-17. Epub Nov. 30, 2012.

Elmer et al., Direct patterning of vertically aligned carbon nanotube arrays to 20 .mu.m pitch using focused laser beam micromachining. Carbon 50, 4114-4122 (2012). Epub Apr. 26, 2012.

Erath et al., Advanced screen printing technique for high definition front side metallization of crystalline silicon solar cells. Sol. Energy Mater. Sol. Cells. 2010;94:57-61. Epub Jun. 13, 2009.

Faddoul et al., Printing force effect on conductive silver tracks: Geometrical, surface, and electrical properties. J. Mater. Eng. Perform. 2013;22:640-9. Epub May 15, 2012.

Forrest, The path to ubiquitous and low-cost organic electronic appliances on plastic. Nature. Apr. 29, 2004;428(6986):911-8.

Fubata et al., Shape-engineerable and highly densely packed single-walled carbon nanotubes and their application as super-capacitor electrodes. Nat Mater. Dec. 2006;5(12):987-94. Epub Nov. 26, 2006.

Fukuda et al., Fully-printed high-performance organic thin-film transistors and circuitry on one-micron-thick polymer films. Nat. Commun. Jun. 20, 2014;5:4147(1-8). doi: 10.1038/ncomms5147.

Gates et al., New approaches to nanofabrication: Molding, printing, and other techniques. Chem Rev. Apr. 2005;105(4): 1171-96.

Gupta et al., Initiated chemical vapor deposition of poly(1H,1H,2H,2H-perfluorodecyl acrylate) thin films. Langmuir. Nov. 21, 2006;22(24):10047-52. Epub Oct. 21, 2006.

Hecht et al., Emerging transparent electrodes based on thin films of carbon nanotubes, graphene, and metallic nanostructures. Adv. Mater. 2011;23:1482-1513.

Higgins et al., Quantitative analysis and optimization of gravure printed metal ink, dielectric, and organic semiconductor films. ACS Appl Mater Interfaces. Mar. 11, 2015;7(9):5045-50. doi: 10.1021/am508316f. Epub Feb. 3, 2015.

Hui et al., Constraints on microcontact printing imposed by stamp deformation. Langmuir. 2002;18(4):1394-1407.

Hung et al., Dip pen nanolithography of conductive silver traces. J. Phys. Chem. C. 2010;114:9672-7. Epub May 7, 2010.

Huo et al., Polymer pen lithography. Science. Sep. 19, 2008;321(5896):1658-60. doi: 10.1126/science.1162193. Epub Aug. 14, 2008.

Hyun et al., Screen printing of highly loaded silver inks on plastic substrates using silicon stencils. ACS Appl. Mater. Interfaces. Jun. 17, 2015;7(23):12619-24. Epub Jun. 2, 2015.

Ishikawa et al., Transparent electronics based on transfer printed aligned carbon nanotubes on rigid and flexible substrates. ACS Nano. Jan. 27, 2009;3(1):73-9. doi: 10.1021/nn800434d. Epub Dec. 10, 2008.

Jacobs et al., Submicrometer patterning of charge in thin-film electrets. Science. Mar. 2, 2001;291(5509):1763-6.

Jung et al., All-printed and roll-to-roll-printable 13.56-MHz-operated 1 -bit RF tag on plastic foils. IEEE Trans. Electron Devices. Mar. 2010;57(3):571-80.

Kamyshny et al., Conductive nanomaterials for printed electronics. Small. Sep. 10, 2014;10(17):3515-35.

Kang et al., High-performance printed transistors realized using femtoliter gravure-printed sub-10 μm metallic nanoparticle patterns and highly uniform polymer dielectric and semiconductor layers. Adv Mater. Jun. 12, 2012;24(22):3065-9. doi: 10.1002/adma.201200924. Epub May 9, 2012.

(56) References Cited

OTHER PUBLICATIONS

Kaufmann et al., Stamps, inks and substrates: Polymers in microcontact printing. Polymer Chem. 2010;1:371-87. Epub Jan. 11, 2010.
Khan et al., Technologies for printing sensors and electronics over large flexible substrates: A review. IEEE Sens J. Jun. 2015;15(6):3164-85.
Kim et al., Properties of piezoelectric actuator on silicon membrane, prepared by screen printing method. Mater Chem Phys. 2005;90:401-4.
Kim et al., Full-colour quantum dot displays fabricated by transfer printing. Nat. Photonics. Mar. 2011;5:176-82. Epub Feb. 20, 2011.
Kim et al., Cu mesh for flexible transparent conductive electrodes. Sci Rep. Jun. 3, 2015;5:10715(1-8). doi: 10.1038/srep10715.
Krebs et al., Product integration of compact roll-to-roll processed polymer solar cell modules: Methods and manufacture using flexographic printing, slot-die coating and rotary screen printing. J. Mater. Chem. 2010;20:8994-9001. Epub Jul. 8, 2010.
Krebs et al., Upscaling of polymer solar cell fabrication using full roll-to-roll processing. Nanoscale. Jun. 2010;2(6):873-86. Epub May 4, 2010.
Kwak et al., Fabrication of conductive metal lines by plate-to-roll pattern transfer utilizing edge dewetting and flexographic printing. J Colloid Interface Sci. Mar. 1, 2010;343(l):301-5. doi: 10.1016/j.jcis.2009.11.003. Epub Nov. 10, 2009.
Lee et al., Versatile carbon hybrid films composed of vertical carbon nanotubes grown on mechanically compliant graphene films. Adv Mater. Mar. 19, 2010;22(11):1247-52. doi: 10.1002/adma.200903063.
Lee et al., Wet microcontact printing (μCP) for micro-reservoir drug delivery systems. Biofabrication. Jun. 2013;5(2):025011(1-10). doi: 10.1088/1758-5082/5/2/025011. Epub Apr. 26, 2013.
Lee et al., Wafer-scale synthesis and transfer of graphene films. Nano Lett. Feb. 10, 2010;10(2):490-3. doi: 10.1021/nl903272n. Epub Jan. 4, 2010.
Lee et al., Large-scale synthesis of copper nanoparticles by chemically controlled reduction for applications of inkjet-printed electronics. Nanotechnology. Oct. 15, 2008;19(41):415604(1-7). doi: 10.1088/0957-4484/19/41/415604. Epub Sep. 4, 2008.
Lee et al., Inkjet printing of nanosized silver colloids. Nanotechnology. Oct. 2005;16(10):2436-41. Epub Sep. 2, 2005.
Leem et al., Efficient organic solar cells with solution-processed silver nanowire electrodes. Adv Mater. Oct. 11, 2011;23(38):4371-5. doi: 10.1002/adma.201100871. Epub Aug. 22, 2011.
Li et al., Organic light-emitting diodes having carbon nanotube anodes. Nano Lett. Nov. 2006;6(11):2472-7. Epub Oct. 3, 2006.
Loo et al., Interfacial chemistries for nanoscale transfer printing. J Am Chem Soc. Jul. 3, 2002;124(26):7654-5. Epub Jun. 5, 2002.
Maschmann et al., Visualizing strain evolution and coordinated buckling within CNT arrays by in situ digital image correlation. Adv Funct Mater. 2012;22:4686-95.
Maschmann et al., Continuum analysis of carbon nano tube array buckling enabled by anisotropic elastic measurements and modeling. Carbon. 2014;66:377-86. Epub Sep. 13, 2013.
Meshot et al., High-speed in Situ X-ray scattering of carbon nanotube film nucleation and selforganization. ACS Nano. Jun. 26, 2012;6(6):5091-101. doi: 10.1021/nn300758f. Epub May 9, 2012.
Moonen et al., Fabrication of transistors on flexible substrates: from mass-printing to high-resolution alternative lithography strategies. Adv Mater. Nov. 2, 2012;24(41):5526-41. doi: 10.1002/adma.201202949. Epub Aug. 13, 2012.
Noh et al., Scalability of roll-to-roll gravure-printed electrodes on plastic foils. IEEE Trans. Electron. Packag. Manuf. Oct. 2010;33(4):275-83.
Oliver et al., Measurement of hardness and elastic modulus by instrumented indentation: Advances in understanding and refinements to methodology. J. Mater. Res. Jan. 2004;19(1):3-20.
Onses et al., Mechanisms, capabilities, and applications of high-resolution electrohydrodynamic jet printing. Small. Sep. 9, 2015;11(34):4237-66. doi: 10.1002/smll.201500593. Epub Jun. 29, 2015.
Park et al., High-resolution electrohydrodynamic jet printing. Nat Mater. Oct. 2007;6(10):782-9. Epub Aug. 5, 2007.
Pathak et al., Higher recovery and better energy dissipation at faster strain rates in carbon nanotube bundles: an in-Situ study. ACS Nano. Mar. 27, 2012;6(3):2189-97. doi: 10.1021/nn300376j. Epub Feb. 14, 2012.
Perelaer et al., Plasma and microwave flash sintering of a tailored silver nanoparticle ink, yielding 60% bulk conductivity on cost-effective polymer foils. Adv Mater. Aug. 2, 2012;24(29):3993-8. doi: 10.1002/adma.201200899. Epub Jun. 21, 2012.
Perl et al., Microcontact printing: Limitations and achievements. Adv. Mater. 2009;21:2257-68.
Petrzelka et al., Static load-displacement behavior of PDMS microfeatures for soft lithography. J. Micromech. Microeng. 2012;22:075015(1-12).
Piner et al., "Dip-Pen" nanolithography. Science. Jan. 29, 1999;283(5402):661-3.
Pudas et al., Printing parameters and ink components affecting ultra-fine-line gravure-offset printing for electronics applications. J Eur Ceram Soc. 2004;24:2943-50.
Rajabifar et al., Three-dimensional machining of carbon nanotube forests using water-assisted scanning electron microscope processing. Appl. Phys. Lett. 2015;107:143102(l-5). Epub Oct. 5, 2015.
Rogers et al., Paper-like electronic displays: Large-area rubber-stamped plastic sheets of electronics and microencapsulated electrophoretic inks. Proc Natl Acad Sci U S A. Apr. 24, 2001;98(9):4835-40.
Service, Patterning electronics on the cheap. Science. Oct. 1997;278(5337):383-4.
Singh et al., Inkjet printing—Process and its applications. Adv. Mater. Feb. 9, 2010;22(6):673-85. doi: 10.1002/adma.200901141.
Suhr et al., Fatigue resistance of aligned carbon nanotube arrays under cyclic compression. Nat Nanotechnol. Jul. 2007;2(7):417-21. doi: 10.1038/nnano.2007.186. Epub Jul. 1, 2007.
Tawfick et al., Mechanics of capillary forming of aligned carbon nanotube assemblies. Langmuir. Apr. 30, 2013;29(17):5190-8. doi: 10.1021/la4002219. Epub Mar. 28, 2013.
Tseng et al., All inkjet-printed, fully self-aligned transistors for low-cost circuit applications. Org. Electron. 2011;12:249-56. Epub Nov. 30, 2010.
Want, RFID. A key to automating everything. Sci Am. Jan. 2004;290(1):56-65.
Weibel et al., Bacterial printing press that regenerates its ink: contact-printing bacteria using hydrogel stamps. Langmuir. Jul. 5, 2005;21(14):6436-42. Epub Apr. 8, 2004.
Weibel et al., Microfabrication meets microbiology. Nat Rev Microbiol. Mar. 2007;5(3):209-18.
Wilbur et al., Microfabrication by microcontact printing of self-assembled monolayers. Adv. Mater. 1994;6(7-8):600-4.
Wirth et al., Surface properties of vertically aligned carbon nanotube arrays. Diamond Relat. Mater. 2008;17:1518-24. Epub Dec. 17, 2007.
Xu et al., Porous multilayer-coated PDMS stamps for protein printing. Langmuir. Dec. 15, 2009;25(24): 13972-7. doi: 10.1021/la901797n. Epub Jul. 13, 2009.
Xu et al., Microcontact printing of dendrimers, proteins, and nanoparticles by porous stamps. J Am Chem Soc. 2009;131(2):798-803. Epub Dec. 22, 2008.
Yang et al., Conductive adhesives as the ultralow cost RFID tag antenna material. Current Trends and Challenges in RFID, Intech, Chapter 7, Jul. 2011. pp. 127-150. Epub Jul. 20, 2011.
Yeom et al., Detachment lithography of photosensitive polymers: A route to fabricating three-dimensional structures. Adv Funct Mater. 2010;20:289-95.
Zhou et al., Flexure-based roll-to-roll platform: A practical solution for realizing large-area microcontact printing. Sci Rep. Jun. 3, 2015;5:10402(1-10). doi: 10.1038/srep10402.
Garcia, E. J. et al., Fabrication and Nanocompression Testing of Aligned Carbon-Nano tube-Polymer Nanocomposites. Adv. Mater., vol. 19, pp. 2151-2156 (2007); retrieved from the Internet on May 11, 2016; <URL:http://mechanosynthesis.mit.edu/journals/015_ejgarcia_amat_07_nanocompres- sion>.

(56) References Cited

OTHER PUBLICATIONS

Hart, A. J. et al., Rapid growth and flow-mediated nucleation of millimeter-scale aligned carbon nanotube structures from a thin-film catalyst, Journal of Physical Chemistry B, vol. 110, pp. 8250-8257 (2006).
International Preliminary Report on Patentability dated Jun. 8, 2017 for International Application No. PCT/US2015/62606, 8 pages.
International Search Report and Written Opinion dated Jun. 3, 2016 for International Application No. PCT/US2015/62606, 11 pages.
Invitation to Pay Additional Fees dated Mar. 24, 2016 for International Application No. PCT/US2015/62606, 3 pages.
Kim, D. et al., Magnetic-field-induced liquid metal droplet manipulation. Journal of Micromechanics and Microengineering, vol. 24, No. 5, 055018, 7 pages (2014).
Non-Final Office Action dated Sep. 26, 2017 for U.S. Appl. No. 14/951,854, 10 pages.
Non-Final Office Action dated Jun. 21, 2019 for U.S. Appl. No. 15/833,105, 8 pages.
Tawfick, S. et al., Nanocomposite microstructures with tunable mechanical and chemical properties. Physical Chemistry Chemical Physics, vol. 12, pp. 4446-4451 (2010).
Yaglioglu, O. et al., Wide range control of microstructure and mechanical properties of carbon nanotube forests: a comparison between fixed and floating catalyst CVD techniques. Advanced Functional Materials, vol. 22, No. 23, pp. 5028-5037 (2012).
International Preliminary Report on Patentability for International Application No. PCT/US2018/012509, dated Jul. 16, 2020.
Bedewy, Data-driven understanding of collective carbon nanotube growth by in situ characterization and nanoscale metrology. J. Mater. Res. Jan. 13, 2017;32(1):153-65.
Nishimura et al., In Situ Study of Iron Catalysts for Carbon Nanotube Growth Using X-Ray Diffraction Analysis. Japanese Journal of Applied Physics. Mar. 2004;43(4A):L471-4.
Rao et al., Maximization of carbon nanotube yield by solid carbon-assisted dewetting of iron catalyst films. Carbon. 2020;165:251-8. Epub Apr. 23, 2020.

* cited by examiner

APPARATUS AND METHODS FOR CONTACT-PRINTING USING ELECTROSTATIC NANOPOROUS STAMPS

RELATED APPLICATIONS

This application is a national stage filing under 35 U.S.C. § 371 of International Patent Application Serial No. PCT/US2018/012509, filed Jan. 5, 2018, and entitled "Apparatus and Methods for Contact-Printing Using Electrostatic Nanoporous Stamps," which is incorporated herein by reference in its entirety for all purposes.

BACKGROUND

Methods for printing include screen, gravure, relief, and inkjet printing. The resolution of inkjet printing is determined by the size of the droplet ejected from the nozzle aperture, and due to the limiting strength and frequency of transducers compared to the force required to eject smaller liquid droplets, the droplet diameter is usually no smaller than about 10 μm to about 20 μm. Gravure printing uses ink transfer from individual cells engraved on the tool surface, thus the size and shape of the cells influence the printing resolution. In relief printing, a thin film of ink is first loaded from a textured roll onto to the top surfaces of the stamp, and is subsequently printed by pressing the stamp against the target. The resolution of relief printing has been more limited than inkjet and gravure printing because thin liquid films loaded on the solid stamps tend to dewet from the surface (e.g., due to hydrodynamic thin film instability) while thick films tend to spread outwards from the contact area. As a result, relief printing of uniform ink layers has generally limited feature sizes to 50 μm or larger.

SUMMARY

Inventive implementations of the present technology generally relate to methods and apparatus for contact printing. In one example, an apparatus for contact printing using an ink includes a substrate, a conductive layer disposed on the substrate, and a plurality of microstructures disposed on the conductive layer. Each microstructure includes a porous medium comprising a conductive material. The apparatus also includes a dielectric layer conformally disposed on the plurality of microstructures and configured to electrically insulate the plurality of microstructures from the ink during use.

In another example, a method of contact printing using a nanoporous print stamp includes contacting the nanoporous print stamp with an ink and applying a voltage between a conductive layer in the nanoporous print stamp and the ink to load the ink into a dielectric-coated porous medium disposed on the conductive layer based at least in part on an electrostatic force between the nanoporous print stamp and the ink. The dielectric-coated porous medium includes a conductive porous medium conformally coated with a dielectric layer. The method also includes contacting the nanoporous print stamp with a target substrate and adjusting an amplitude of the voltage between the conductive layer and the ink to release the ink from the nanoporous print stamp and onto the target substrate so as to form a pattern.

In yet another example, a nanoporous print stamp for contact printing using an ink includes a substrate, an array of electrodes disposed on the substrate, and an array of microstructures. Each microstructure is disposed on a corresponding electrode in the array of electrodes and includes a group of vertically aligned carbon nanotubes extending from the corresponding electrode. The group of carbon nanotubes has: (a) a top section having an average pore size of about 100 nm or less; and (b) a lateral size of about 10 μm to about 100 μm. The stamp further includes a dielectric layer conformally disposed on the array of microstructures and configured to electrically insulate the array of microstructures from the ink during use.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features.

DETAILED DESCRIPTION

Electrostatic Nanoporous Print Stamps

Figure 1:
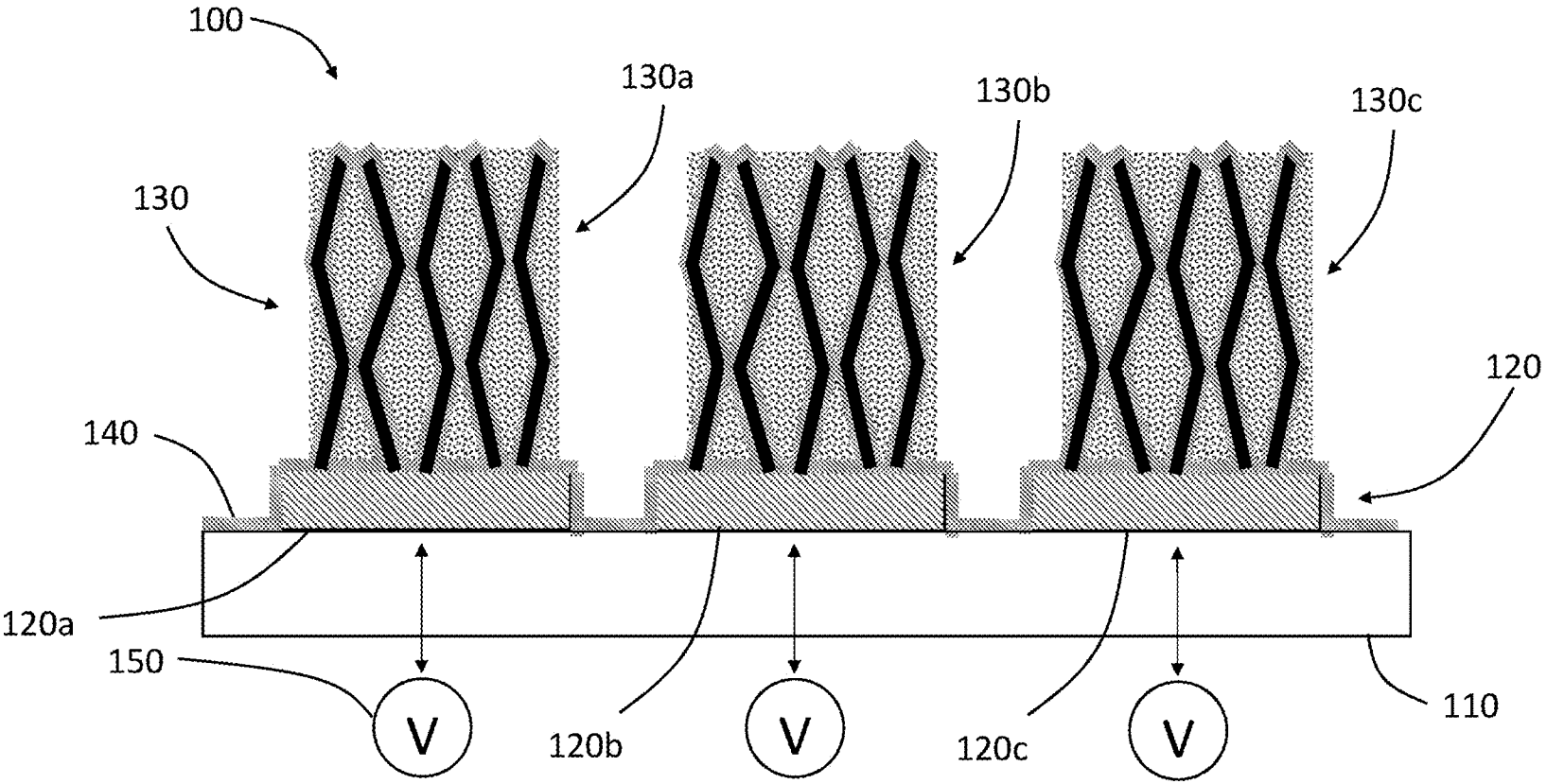
FIG. 1 shows a schematic of an apparatus for contact printing according to one inventive implementation.

As set forth in detail below, inventive methods and apparatus for contact printing based on electrostatic force generally employ dielectric-coated conductive porous medium (e.g., a collection of conductive fibers) disposed on a substrate to attract and release ink based in part on an electric potential (voltage) applied to one or more of the conductive fibers (or groups of conductive fibers). In one example implementation, an inventive apparatus for contact printing is implemented as an "electrostatic nanoporous print stamp," in which groups of conductive fibers may be arranged on a substrate, and wherein each group of conductive fibers comprises a microstructured array of fibers having cross-sectional dimensions on a nanometer scale.

More specifically, in one example, an electrostatic nanoporous print stamp including multiple microstructured arrays of conductive fibers (e.g., carbon nanotube arrays, or CNT arrays) can be used to achieve high resolution printing of liquid inks, including colored inks for graphics and electronically functional inks for printed electronics. In this technology, the CNTs can be grown from thin-film catalysts on silicon substrates and form vertically aligned "forests" or "arrays," i.e., individual CNTs in a given microstructured array are substantially perpendicular to the substrate. In addition, the thin film catalysts can be fabricated into various patterns using, for example, lithographic patterning and compatible chemical vapor deposition (CVD) process, thereby fabricating versatile micro- and nano-structures of CNT arrays.

The CNT arrays can be coated with functional polymers to achieve high porosity (e.g., greater than 90%) such that the liquid ink can be confined inside the microstructures. The CNT arrays also have good structural robustness against capillary forces upon liquid infiltration and evaporation, while maintaining sufficient compliance (e.g., elastic modulus of about 30 MPa) for conformal contact against the target substrate. As a result, upon contact with the target substrate, liquid ink is transferred locally via the porous surface of the stamp, thereby realizing excellent replication of stamp patterns with uniform thickness. The CNT stamps can print liquid inks with feature sizes smaller than 10 μm, which enables a printing resolution at about 2500 dots per inch (dpi) or greater. Moreover, printing of thin, uniform layers is advantageous for electronic device fabrication, such as thin film transistors, where a variety materials is deposited and patterned in spatially registered layers.

For printed electronics, the dimensions of each layer usually affect the device functionalities. Existing nanoporous stamps can produce high lateral resolution (i.e. replicates the stamp pattern) and uniform thickness of the printed layer. However, it can be challenging to precisely control (e.g., with sub-micron accuracy) the layer thickness, which typically depends on the amount of ink transferred from the stamp to the target substrate during printing.

To improve the control over the layer thickness of the printed pattern, as noted above the apparatus and methods described herein employ a plurality of conductive fibers that facilitate significant control of the amount of transferred ink via electrostatic forces. In one example, an apparatus includes a plurality of conductive microstructures disposed on an electrode layer to form a porous top section. A conformal dielectric layer is deposited on the conductive microstructures so as to electrically insulate the conductive microstructures from the ink during use. In operation, a voltage is applied on at least some of the conductive microstructures, via the electrode layer, so as to create an electrostatic force to attract the ink, thereby facilitating the loading of the ink onto the porous top section of the apparatus. The amount of ink loaded onto the apparatus can be controlled by the amplitude of the applied voltage. Upon contacting a target substrate, the voltage can be removed or reduced to release the ink onto the target substrate, thereby forming a pattern on the substrate.

FIG. 1 shows a schematic of an apparatus 100, according to one inventive implementation, in the form of an electrostatic nanoporous print stamp. The apparatus 100 includes a substrate 110 and a conductive layer 120 disposed on the substrate 110. A plurality of conductive microstructures 130 (also referred to as a conductive porous medium 130) is disposed on the conductive layer 120 to form a nanoporous structure that can be filled with liquid ink 160. The nanoporous structure can have pores on the nano-scale (more dimensions are provided below). A dielectric layer 140 is conformally coated on the plurality of conductive microstructures 130, as well as the portion of the top surface of the conducive layer 120 not covered by the plurality of conductive microstructures 130. The combination of the dielectric layer 140 and the conductive porous medium 130 is also referred to as a dielectric-coated porous medium. The dielectric layer 140 can electrically insulate the plurality of conductive microstructures 130 from the liquid ink 160. When conductive fibers (e.g., carbon nanotubes or other conductive nanowires) are used in the microstructures 130, the dielectric layer 140 is conformally coated on the surface of each conductive fiber for insulation.

In operation, the conductive layer 120 can be connected to a voltage source 150 (e.g., a power supply), which applies a voltage between the conductive microstructures 130 and the liquid ink 160. Due to the insulation of the dielectric layer 140, electrically charges do not freely move between the microstructures 130 and the liquid ink 160. Instead, electrical charges having opposite polarities accumulate near the boundary between the microstructures 130 and the liquid ink 160, thereby creating an electrostatic force to attract the liquid ink 160 to the microstructures 130. The amount of liquid ink 160 that is loaded within the microstructures 130 (and accordingly the amount of liquid ink 160 that can be released onto the target substrate during printing) depends at least in part on the amplitude of the applied voltage. Therefore, by adjusting the voltage, one can effectively control the thickness of the pattern printed by the apparatus 100.

The substrate 110 in the apparatus 100 can serve as a holder to hold the microstructures 130. In one example, the substrate 110 can include a metal, in which case the conductive layer 120 can be optional. In another example, the substrate 110 can include a ceramic. In yet another example, the substrate 110 can include a polymer.

In one example, the substrate 110 can be rigid, while the conductive microstructures 130 are mechanically compliant and durable, thereby allowing conformal contact between the apparatus 100 and the target substrate without significant buckling or yielding of the microscale features on the apparatus. In another example, the substrate 110 can be flexible (e.g., bendable or deformable). In this instance, the apparatus 100 can be employed to print on non-planar surfaces, such as a spherical surface, a cylindrical surface, or an elliptical surface, among others, by deforming the substrate 110 to fit the shape of the non-planar surfaces. The non-planar surface can further include surface irregularities (e.g., surface roughness or any other smaller scale irregularities on the scale of micrometers or less) that can be addressed by the compliance of the microstructures 130. In other words, the flexible substrate 110 can accommodate irregularities on a coarse scale, and the compliance of the microstructures 130 can accommodate irregularities on a fine scale.

The conductive layer 120 in the stamp 100 functions as an electrode to apply voltages on the conductive microstructures 130. In one example, the conductive layer 120 includes one electrode shared by all the microstructures 130. In another example, the conductive layer 120 can include a first section underneath a first subset of one or more microstructures and a second section underneath a second subset of one or more microstructures. In this instance, a voltage can be applied between the first subset of microstructures and the second subset of microstructures so as to create the electrostatic force. In yet another example, the conductive layer 120 can include a plurality of electrodes, each of which is underneath a microstructure (or a group of microstructures) so as to allow individual control of each microstructure (or each group of microstructures). The conductive layer 120 can include a variety of appropriate conductive materials, such as TiN, silver, and gold, among others.

In one example, each microstructures 130*a/b/c* can include conductive fibers, such as vertically grown nanowires or filaments (e.g., silver). In another example, the microstructures 130 can include carbon nanotubes (CNTs), including single-walled carbon nanotubes or multi-walled carbon nanotubes. The CNTs can be vertically aligned or substantially vertically aligned and extending upward from the conductive layer 120.

In yet another example, the microstructures 130 be made from casting a film of particles, compacting them to create at least a partially fused or sintered assembly that have nanopores defined between the particles In yet another example, the microstructures 130 can include a nanocarbon foam or a cast aerogel. Additionally, a nanoporous surface for a nanoporous stamp may be made from three-dimensional (3D) printing via photo-polymerization, which can create structured features of nanoscale dimensions.

In some examples, the diameter of carbon tubes in the microstructures 130 can have a diameter of about 1 nm to about 50 nm (e.g., about 1 nm, about 2 nm, about 3 nm, about 5 nm, about 10 nm, about 20 nm, about 30 nm, about 40 nm, or about 50 nm, including any values and sub ranges in between).

In one example, all the nanotubes in the respective microstructures 130 can have approximately the same height (e.g., length or distance above the substrate). In another example, the height (or length) of the nanotubes can have a variance of about 10 nm to about 100 nm (e.g., about 10 nm, about 20 nm, about 30 nm, about 40 nm, about 50 nm, about 60 nm, about 70 nm, about 80 nm, about 90 nm, or about 100 nm, including any values and sub ranges in between). This height variance can create roughness of the free surface where the liquid ink 160 can be pinned to the tips of the coated CNTs. In some examples, the height variance of the nanotubes can be about 1% to about 20% of the average height of the nanotubes (e.g., about 1%, about 2%, about 3%, about 5%, about 10%, about 15%, or about 20%, including any values and sub ranges in between).

In one example, the microstructures 130 can have a regular pattern on the substrate 110, such as a two-dimensional (2D) matrix. Each microstructure (or each group of microstructures) can function as a pixel in printing. In this instance, each microstructure (e.g., 130*a/b/c* in FIG. 1) can include a group of conductive fibers or CNTs (see FIGS. 2A-2D), and the conductive layer 120 can include an array of electrodes 120*a-c*, each of which is disposed underneath a corresponding microstructure (or each group of microstructures). Therefore, each microstructure (or each group of microstructures) can be individually controlled to load and release the liquid ink 160. During printing, applying voltages to a first subset of microstructures (or groups of microstructures) can print a first pattern and applying voltages to a second subset of microstructures (or groups of microstructures) can print a second pattern, i.e., digital printing. Additional details about digital printing implementations are described below.

In another example, the microstructures 130 can form a pre-determined pattern similar to the pattern to be printed. In this instance, each microstructure 130*a/b/c* can include a group of conductive fibers or carbon nanotubes (or any other appropriate structure), and all the microstructures 130 can share the same conductive layer 120 as the electrode to apply the voltage. In some examples where CNTs are used in the microstructures 130, the CNTs may be bonded or reinforced to prevent capillary-induced deformation of the CNT microstructures while retaining the desired porosity.

The nanoporous structure formed by the array of microstructures 130 can be characterized by the size of the pores (also referred to as the pore size). The pore size can be measured as the average distance between adjacent microstructures in the array of microstructures 130. Alternatively, the pore size can be measured as the average void size or diameter defined by the microstructures 130 when the microstructures 130 include porous medium such as particles. Depending on the implementation, the pore size can be less than 1 μm (e.g., about 1 μm, about 500 nm, about 400 nm, about 300 nm, about 200 nm, about 100 nm, about 50 nm, about 25 nm, about 20 nm, about 15 nm, about 10 nm or less, including any values and sub ranges in between).

The porosity (also referred to as the void fraction) of the nanoporous structure defined by the microstructures 130 can be about 10% to about 99% (e.g., about 10%, about 20%, about 30%, about 40%, about 50%, about 60%, about 70%, about 80%, about 90%, about 95%, about 97%, about 98%, or about 99%, including any values and sub ranges in between). The dielectric layer 140 usually decreases the porosity of the nanoporous structure. In some examples, the above porosities are referred to the porosity after taking into account the dielectric layer 140.

In some implementations, the liquid ink 160 can include functional micro-particles or nanoparticles having a particle size. In this instance, the pore size can be greater than the particle size. For example, the ratio of the pore size to the particle size can be about 1.5 to about 10 (e.g., about 1.5, about 2, about 2.5, about 3, about 3.5, about 4, about 4.5, about 5, about 5.5, about 6, about 6.5, about 7, about 7.5, about 8, about 8.5, about 9, about 9.5, or about 10, including any values and sub ranges in between). In another example, the pore size can be significantly greater than the particle size (e.g., about 1 order of magnitude greater, about 2 orders of magnitudes greater, or about 3 orders of magnitude greater).

On the other hand, the pore size can be smaller than the feature size of the pattern to be printed. The feature size can be defined as the width of the narrowest lines printed by the stamp 100. For example, the ratio of the pore size to the feature size can be about 0.2 to about $10^{-4}$ (e.g., about 0.2, about 0.1, about 0.05, about 0.01, about $5\times10^{-3}$, about $10^{-3}$, about $5\times10^{-4}$, or about $10^{-4}$, including any values and sub ranges in between). The feature size can be, for example, about 10 μm or less (e.g., about 10 μm, about 9 μm, about 8 μm, about 7 μm, about 6 μm, about 5 μm, about 4 μm, about 3 μm, about 2 μm, about 1 μm, or less, including any values and sub ranges in between).

As described herein, the appropriate surface compliance of the stamp 100 enables the microstructures 130 to conformally contact a target substrate during printing, allowing effective ink transfer with nanoscale thickness and high uniformity. According to some inventive implementations where CNTs are used, the surface chemistry of the CNTs can be engineered to enable infiltration of the ink into the spacing between CNTs and to reduce or prevent elastocapillary densification of the CNT microstructures. For example, a CNT forest synthesized by CVD may be hydrophobic, and subsequent oxygen plasma etching may create surface defects and promote attachment of oxygen-containing surface groups, thereby rendering the CNT forest hydrophilic.

The thickness of the dielectric layer 140 can affect the apparatus 100 in at least two ways. On the one hand, a thinner dielectric layer 140 allows a stronger electrostatic force to be built between the apparatus 100 and the liquid ink 160. On the other hand, however, a thicker dielectric layer 140 can ensure that the respective microstructures 130 are well insulated. In some examples, the thickness of the dielectric layer 140 can be about 1 nm to about 20 nm (e.g., about 1 nm, about 2 nm, about 3 nm, about 5 nm, about 10 nm, about 15 nm, or about 20 nm, including any values and sub ranges in between).

Various materials can be used for the dielectric layer 140. For example, the dielectric layer 140 can include polymer or ceramic (e.g., $Al_2O_3$). The surface wettability or adhesive energy of the apparatus 100 can, in some embodiments, be tuned or configured by selecting appropriate material(s) for the dielectric layer 140. For example, in implementations where the conductive fibers are nanotubes, a polymer coating can be applied to or disposed on the nanotubes, and the polymer coating forms bonds between at least a portion of the nanotubes. One or more polymers can be selected based on the particular implementation where utilized, and can include one or more of the following: a fluoropolymer, a polyacrylate, a polyfluoroacrylate, and/or a polyperfluorodecylacrylate. Additional exemplary polymers can include, depending on the embodiment and by way of non-limiting example: dimethylaminomethyl)styrene (DMAMS); (2-hydroxyethyl) methacrylate (HEMA);1-vinyl-2-pyrrolidone (VP); ethylene glycol diacrylate (EGDA); trivinyltrimethylcyclotrisiloxane (V3D3); methacrylic acid (MAA); ethlacrylate; and/or glycidyl methacrylate (GMA).

Further examples of materials that can be used for the dielectric layer 140 include poly-perfluorodecylacrylate, or p(PFDA). The PFDA monomer diffuses into the porous CNT microstructures in the vapor phase and results in a conformal coating of the CNTs. In this example, the iCVD polymer coating is followed by a second oxygen plasma treatment to remove any pPFDA deposited in a nonconformal manner as a result condensation the monomer at the tip of the CNT forest. The pPFDA-coated CNT microstructures do not shrink substantially or collapse upon liquid infiltration and solvent evaporation.

A second treatment on the dielectric layer 140 (e.g., plasma treatment) can assist or enable ink infiltration for printing by increasing the surface modulus and uniaxial compressive modulus of the dielectric-coated conductive porous medium. The dielectric layer 140 can increase resistance to elastocapillary densification via reinforcing individual CNTs and/or forming nanowelds at CNT-CNT contact point. In the example, the pFDA coating can increase resistance to elastocapillary densification by reinforcement of individual CNTs by the pPFDA coating as well as formation of pPFDA nanowelds at CNT-CNT contact points.

Fabrications of Electrostatic Nanoporous Print Stamps

FIGS. 2A-2D illustrate a method 200 of fabricating the apparatus 100 of FIG. 1 according to one inventive implementation. More specifically, the method 200 provides an apparatus in the form of an electrostatic nanoporous print stamp including carbon nanotubes to form multiple microstructures arranged as a two-dimensional (2D) array. It should be appreciated that the method 200 may be employed (in whole or in part) to fabricate similar apparatus having a variety of numbers and arrangements of respective microstructures (e.g., one-dimensional arrays of microstructures, various periodic or non-periodic arrangements of microstructures, particular patterns of microstructures, etc.).

Figures 2A, 2B, 2C, 2D:
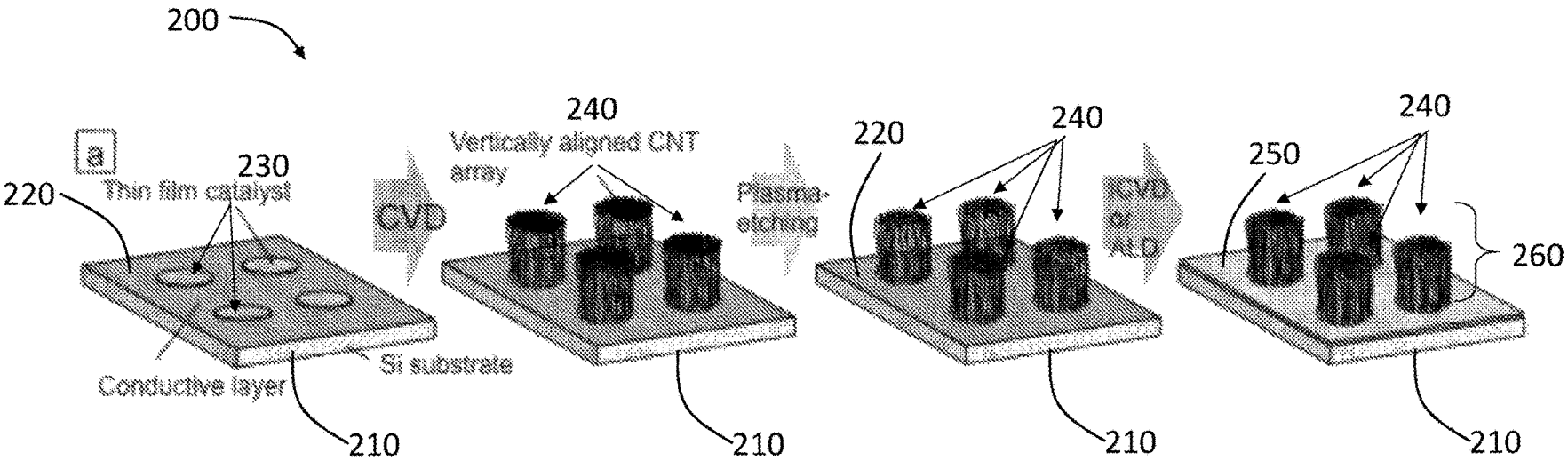
FIGS. 2A-2D illustrate a method of fabricating the apparatus of FIG. 1 according to one inventive implementation.

The method 200 starts with a substrate 210 as shown in FIG. 2A. Various materials can be used for the substrate 210. In one example, the substrate includes silicon, such as a 4" (100) silicon wafer coated with 300 nm of thermally grown $SiO_2$. In another example, the substrate can include gold, quartz, glass, copper, aluminum, graphite, aluminum oxide, and the like, and/or mixtures thereof. A conductive layer 220 is formed on the substrate 210 via, for example, chemical vapor deposition (CVD) or physical vapor deposition (PVD). The conductive layer 220 can include any appropriate conductive material, such as TiN. In some examples, the thickness of the conductive layer 220 can be about 20 nm to about 200 nm (e.g., about 20 nm, about 30 nm, about 50 nm, about 100 nm, about 150 nm, or about 200 nm, including any values and sub ranges in between).

FIG. 2A also shows that a catalyst layer 230 is formed on the conductive layer 220. The catalyst layer 230 can further include a first sublayer of Fe disposed on a second sublayer of $Al_2O_3$, both of which can be deposited by electron beam physical vapor deposition. The thickness of the Fe layer can be, for example, about 1 nm, and the thickness of the $Al_2O_3$ layer can be, for example, about 10 nm. As shown in FIG. 2A, the catalyst layer 230 is patterned into an array of catalyst sections. The patterning can be carried out via, for example, lithography. The patterned catalyst layer 230 can be substantially similar to the desired pattern of the microstructures (e.g., forest of carbon nanotubes) to be grown on the catalyst. For example, the catalyst layer 230 can include a periodic 2D array. The pitch of the array can be, for example, about 1 μm to about 200 μm (e.g., about 1 μm, about 2 μm, about 3 μm, about 5 μm, about 10 μm, about 20 μm, about 30 μm, about 50 μm, about 100 μm, or about 200 μm, including any values and sub ranges in between).

FIG. 2B shows that vertically aligned CNTs forming microstructures 240 are grown s via, for example, a CVD process at atmospheric pressure. The CNTs forming the microstructures 240 preferably grow on the catalyst sections on the conductive layer 230. Therefore, the pattern of the microstructures 240 can be controlled by the pattern of the catalyst layer 230. The height of the microstructures 240 can be about 0.2 μm to about 1000 μm (e.g., about 0.2 μm, about 0.5 μm, about 1 μm, about 2 μm, about 5 μm, about 10 μm, about 20 μm, about 30 μm, about 50 μm, about 100 μm, about 200 μm, about 300 μm, about 500 μm, or about 1000 μm, including any values and sub ranges in between). This height can be controlled by the growth time and/or the growth rate of the CVD process. In some examples, the growth rate can be about 50 μm/s to about 100 μm/s (e.g., about 50 μm/s, about 60 μm/s, about 70 μm/s, about 80 μm/s, about 90 μm/s, or about 100 μm/s, including any values and sub ranges in between).

In some examples, the substrate 210 deposited with the catalyst layer 230 can be placed in a quartz tube furnace for the CNT growth. The growth procedure can start with flowing of $He/H_2$ (e.g., at about 100/400 s.c.c.m.) while heating the furnace to a first elevated temperature (e.g., up to 775° C. over a 10-min ramp). The furnace can then be held at the first elevated temperature (e.g., about 775° C.) for an elongated time duration (e.g., about 10 min) with the same gas flow rates for annealing. Then the gas flow can be changed to a mixture of $C_2H_4/He/H_2$ (e.g., at 100/400/100 s.c.c.m.) at the first elevated temperature (e.g., about 775°

C.) for CNT growth. The growth time can be selected to control the height (or length) of the CNTs 240. In some implementations, the typical growth rate can be about 100 μm/min. After the growth, the furnace can be cooled down to a second temperature (e.g., less than 100° C.) at the same gas flow and finally purged with He (e.g., at about 1,000 s.c.c.m. for about 5 min).

In FIG. 2C, a plasma treatment is performed on the microstructures 240. During the CNT growth, the top surface (i.e., surface distal to the substrate 210) of the microstructures 240 may include tangled CNT fibers that can result in a dense cluster layer. Plasma etching can be performed to remove the top cluster layer. In some examples, the plasma etching can use oxygen plasma, in which the CVD grown microstructures 240 can be exposed to the oxygen plasma with 80/20 of $Ar/O_2$ gas flow for 5 min at 50 W and 200 mTorr pressure using a Diener Femto Plasma system. The plasma treatment may etch both the top and sidewalls of the CNTs, thereby slightly narrowing their width. Therefore, this reduction can be taken into account when designing the CNT growth patterns to achieve a target printed feature size.

In FIG. 2D, a dielectric layer 250 is conformally coated on the respective CNTs of the microstructures 240 (including the outer surfaces of the side walls of the respective CNTs) to form an array of dielectric-coated microstructures 260. Each forest in the array can function as a pixel during printing. In one example, the dielectric layer 250 includes ceramic (e.g., $Al_2O_3$) and can be coated via atomic layer deposition (ALD). In another example, the dielectric layer 250 includes polymer, such as p(PFDA), and can be coated via initiated Chemical Vapor Deposition (iCVD). In some examples, the coating material can be hydrophobic. In some other examples, the coating material can be hydrophilic.

For conformal polymer coating, iCVD polymerization can be carried out in a cylindrical reactor (e.g., diameter of about 24.6 cm and height of about 3.8 cm) with an array of 14 parallel chromoalloy filaments (e.g., from Goodfellow) suspended about 2 cm from the stage. The reactor can be covered with a quartz top (e.g., about 2.5 cm thick) that allows real-time thickness monitoring. For example, the thickness of the polymer coating can be monitored by reflecting a laser beam (e.g., 633 nm He—Ne laser beam) off the substrate/polymer and recording the interference signal intensity as a function of time.

The reactor can be pumped down by a mechanical Fomblin pump and the pressure can be monitored with a vacuum gauge (e.g., a MKS capacitive gauge). The liquid monomer can include (e.g., 1H, 1H, 2H, 2H-perfluorodecyl acrylate, PFDA, 97% Aldrich) and the initiator (e.g., tert-butyl peroxide, tributylphosphine oxide (TBPO), 98% Aldrich) can be used as received without further purification. TBPO can be kept at room temperature (e.g., about 25° C.) and can be delivered into the reactor through a mass flow controller (e.g., 1479 MFC, from MKS Instruments) at a constant flow rate (e.g., about 1 s.c.c.m. in process A, about 3 s.c.c.m. and 1 s.c.c.m. in DVB and PFDA polymerization during process B, respectively). Initiator radicals (TBO) can be created by breaking only the labile peroxide bond of the TBPO at filament temperature of about 250° C. during iCVD polymerization. The PFDA monomer can be vaporized in glass jars heated to 80° C. and then introduced to the reactor through needle valves at constant flow rates (e.g., about 0.2 s.c.c.m.).

The substrate temperature can be kept at Ts=30° C. (within ±1° C.) using a recirculating chiller/heater (NESLAB RTE-7). All of the temperatures can be measured by K-type thermocouples (e.g., from Omega Engineering). The working pressure can be maintained at 60 mTorr using a throttle valve (e.g., from MKS Instruments). At the end, an ultrathin layer of pPFDA (approximately 30 nm thick) can be deposited within a 25 minute deposition time. The thickness of the pPFDA, deposited on to a control silicon substrate during iCVD polymerization, can be also measured using ellipsometry.

In some examples, the method 200 can further include plasma treatment on the dielectric layer 250. In addition to functioning as an insulation layer, the dielectric layer 250 can also be configured to bond some of the CNTs 240 together to improve the mechanical strength in the resulting apparatus. The additional plasma treatment can remove any extraneous material from the bonding.

In some embodiments, the mechanical behavior of the dielectric-coated CNT forests 260 can be similar to that of open-cell foams when compressed to moderate strains. The modulus of the dielectric-coated CNTs can be tuned over a wide range based on the diameter, density, and connectivity of the CNTs 240.

Figure 3A:
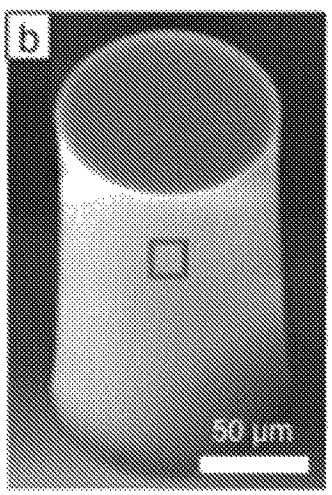
FIGS. 3A-3F show scanning electron microscope (SEM) images of carbon nanotubes (CNTs) fabricated using the method illustrated in FIGS. 2A-2D.
Figure 3B:
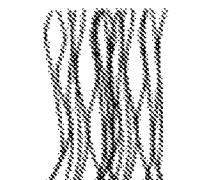
Figure 3C:
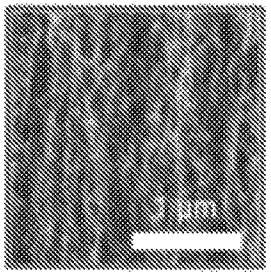

FIG. 3A shows a scanning electron microscope (SEM) image of a CNT pillar vertically grown on a substrate. Each pillar can be used as a microstructure 130*a/b/c* in the apparatus 100 illustrated in FIG. 1. The CNT pillar has a diameter of about 100 μm, which can be controlled by the dimension of the catalyst layer (see, e.g., FIG. 2A). FIG. 3B shows a schematic of the CNT pillar, which includes multiple individual CNTs. FIG. 3C is an SEM image showing a magnified view of a section of the CNT pillar.

Figure 3D:
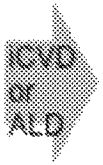
Figure 3D:
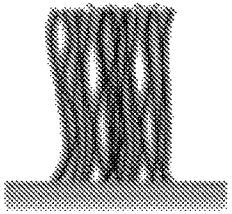
Figure 3E:
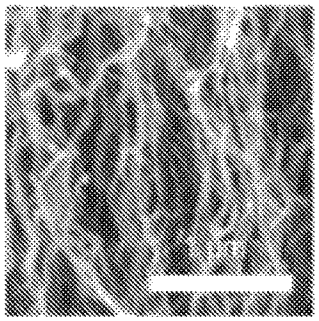
Figure 3F:
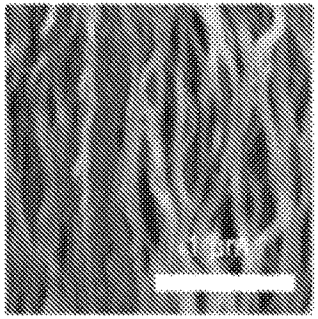

FIG. 3D shows a schematic of CNTs coated with a conformal dielectric layer. The dielectric layer can bond some of the CNTs together to increase the mechanical strength. In addition, the coating materials can also fill some of the space between CNTs and decrease the porosity of the resulting CNT forest. FIG. 3E shows an SEM image of CNTs conformally coated with poly-perfluorodecylacrylate, p(PFDA) via initiated chemical vapor deposition (iCVD). FIG. 3F shows an SEM image of CNTs conformally coated with alumina (i.e. $Al_2O_3$) via atomic layer deposition (ALD).

Methods of Printing Using Electrostatic Nanoporous Print Stamps

Figure 4:
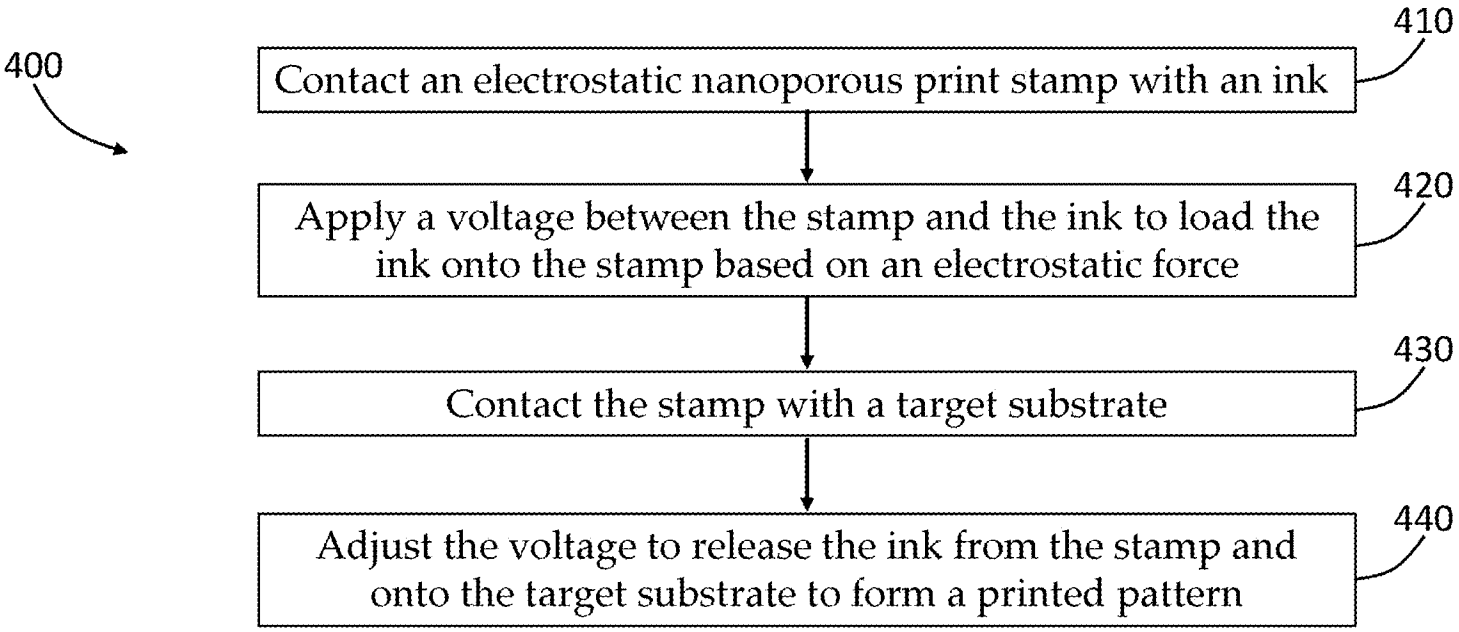
FIG. 4 illustrates a printing method using the apparatus of FIG. 1, according to one inventive implementation.

FIG. 4 illustrates a method 400 of printing using an electrostatic nanoporous stamp (e.g., similar to the apparatus 100 shown in FIG. 1). The stamp includes a substrate, a conductive layer disposed on the substrate, and a plurality of microstructures disposed on the conductive layer. Each microstructure includes a group of conductive fibers extending from the conductive layer. The stamp further includes a dielectric layer conformally disposed on the microstructures. The method 400 includes, at 410, contacting the nanoporous print stamp with a liquid ink. At 420, a voltage is applied between the conductive layer and the ink to load the ink onto the nanoporous print stamp based at least in part on an electrostatic force between the nanoporous print stamp and the ink. The loaded stamp is then placed in contact with a target substrate (i.e. desired location of printing) at 430. At 440, the voltage applied on the stamp is adjusted (e.g., reduced or removed) to release the ink from the nanoporous print stamp and onto the target substrate so as to form a printed pattern.

The steps illustrated in FIG. 4 can be carried out in different orders. For example, the step 420 can be applied before the step 410, i.e., the voltage can be turned on before the stamp is placed in contact with the ink. In another example, step 430 may be optional, in which case the ink can be released onto the target substrate from locations above the target substrate and the ink can drop onto the target substrate under gravity force. In yet another example, steps 430 and 440 can be concurrent, i.e. contacting the print stamp with the target substrate while adjusting the voltage.

Loading Liquid Ink Onto the Stamp

The stamp can be made to be in contact with the liquid ink in various ways. In one example, the ink can be loaded into a pipette, which can then drop the ink onto the stamp. In another example, the ink can be placed onto the stamp via spin coating. In yet another example, the stamp can be moved toward the liquid ink contained in a vessel until the CNT forest contacts the ink.

The loading of the ink onto the stamp can be facilitated by the applied voltage and the resulting electrostatic force. In some examples, the dielectric coating of the stamp can be hydrophilic and the liquid ink can infiltrate into the pores (e.g., the spacing between adjacent conductive fibers) on the stamp via capillary wicking. In this instance, the applied voltage can provide additional force to secure more ink onto the stamp and/or to hold the already loaded ink more closely to the microstructures. In some examples, the dielectric coating of the stamp can be hydrophobic, in which case the liquid ink may not wet the stamp and the electrostatic force can be used to adhere the liquid ink onto the stamp via electrowetting.

Figure 5A:
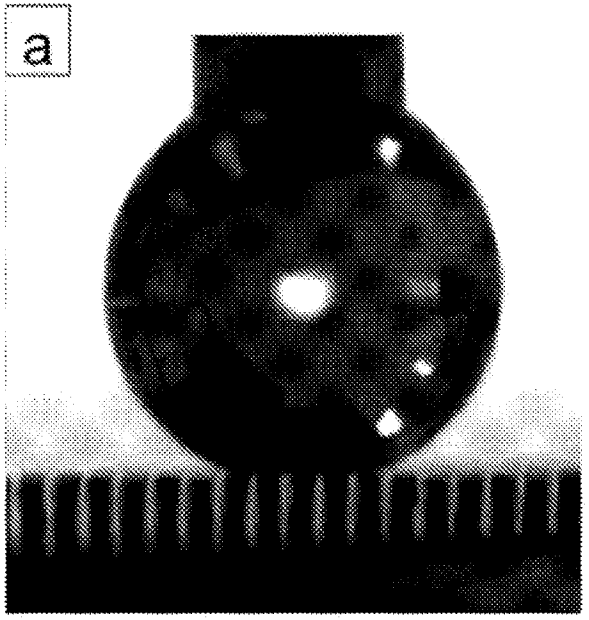
FIG. 5A is an image of a water droplet on an array of CNT pillars coated with a hydrophobic polymer in the apparatus of FIG. 1.

FIG. 5A is an image of a water droplet on an array of CNT pillars coated with a hydrophobic polymer. It can be seen that the water droplet is well separated from the CNT pillars, i.e. the water does not infiltrate into the pores defined by the CNT pillars.

Figures 5B, 5C:
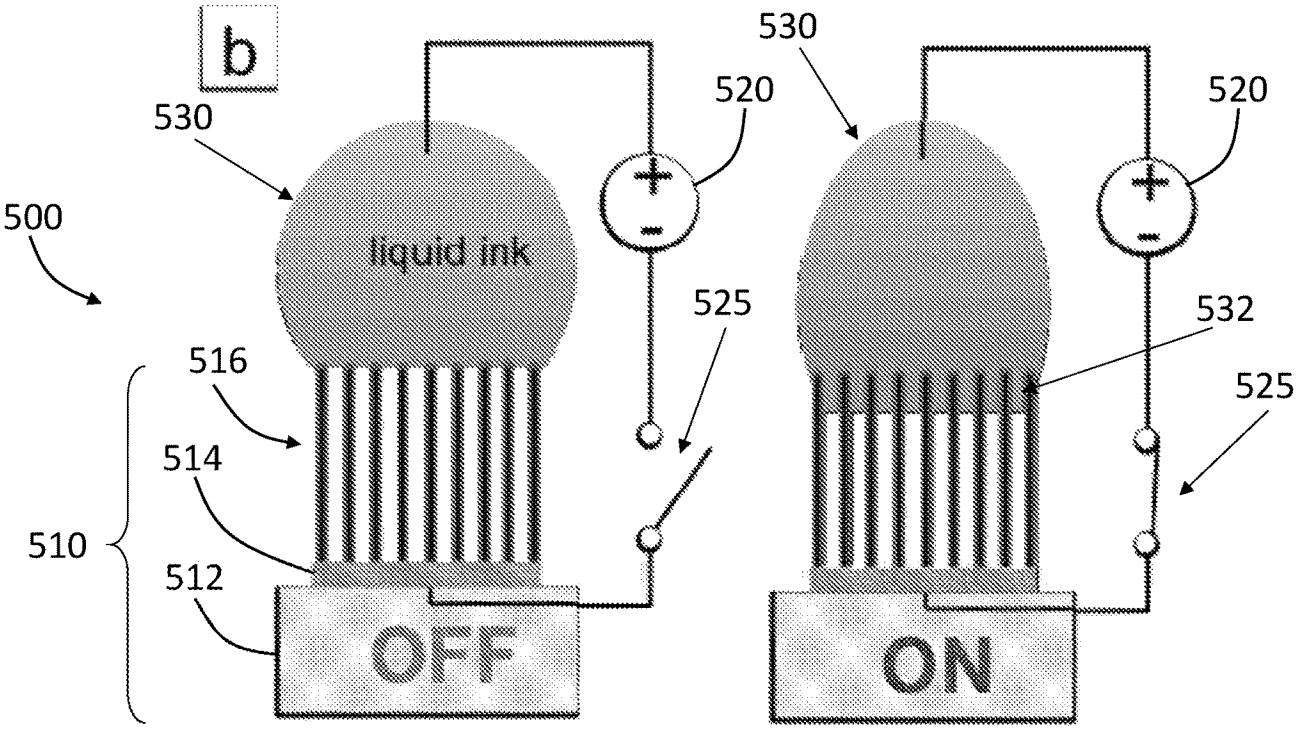
FIGS. 5B and 5C illustrate a method of electrowetting of the apparatus of FIG. 1 according to one inventive implementation.

FIGS. 5B and 5C illustrate a method 500 of electrowetting of an electrostatic nanoporous print stamp 510. In this method 500, the stamp 510 includes an array of dielectric-coated conductive fibers 516 (also referred to as fiber array 516) disposed on an electrode 514, which in turn is disposed on a substrate 512. The array of dielectric-coated conductive fibers 516 can be used as a microstructure 130*a/b/c* in the apparatus 100 illustrated in FIG. 1. A liquid ink 530 is placed on the array of fiber array 516. A power source 520 is electrically connected to the electrode 514 and the liquid ink 530 via a switch 525.

In FIG. 5B, the switch 525 is open and the hydrophobic coating of the stamp 510 prevents the liquid ink 530 from entering the pores in the fiber array 516. In FIG. 5C, the switch is closed and an external voltage is applied between the fiber array 516 and the liquid ink 630. An electrostatic field develops locally at the interface between the fiber array 516 and the liquid ink 630, thereby attracting at least a portion 532 of the liquid ink 530 to wet the stamp surface and allowing the liquid ink 530 to infiltrate into the porous microstructures.

In FIGS. 5B and 5C, the liquid ink 530 is placed on top of the stamp 510. Other configurations can also be used. For example, the stamp 510 can be oriented upside down and contact the liquid ink 530 at the top surface of the liquid ink 530. In another example, the stamp 510 can contact the liquid ink 530 from the side surface of the liquid ink 530. In some examples, the amount of the liquid ink 530 can be very small, such that the gravity force of the liquid ink 530 can be negligible compared to the electrostatic force. As a result, the stamp 510 can contact and load the liquid link 530 from any direction (i.e. independent of the gravity force direction).

The electrowetting illustrated in FIGS. 5B and 5C can significantly improve the quantitative control over the ink loading (and ink release as well) compared to printing techniques based on capillary wicking. In general, increasing the applied voltage can also increase the amount of ink loaded onto the stamp. Since the voltage can be controlled, the ink amount can therefore be effectively controlled with significant precision.

The electrowetting can also benefit stamps with hydrophilic dielectric coating. In this instance, the stamp can load and unload the ink via capillary wicking, but the electrostatic force induced by the voltage can enhance the flexibility of the printing process. For example, the electrostatic force can allow a stamp to load more ink by providing attraction forces in addition to the capillary action. In addition, during contacting with the target substrate, the stamp can release the same amount of ink with less pressure applied on the stamp against the target substrate. This reduced pressure can protect the microstructures from damaging.

Controlling the Amount of Ink Loaded Onto the Stamp

After the initial loading of the ink onto the stamp, the amount of ink held by the stamp can be further modified via various methods. During printing, excessive ink outside the microstructures can be removed, leaving a small amount of ink inside the pores defined by the microstructures. Since the volume of the pores defined by the microstructures can be controlled and quantified during fabrication, the amount of ink contained by the stamp can also be pre-determined.

In one example, the amount of the ink loaded onto the stamp can be controlled by the external voltage applied on the stamp. By increasing or decreasing the voltage, the amount of ink on the stamp can be similarly increased or decreased.

In another example, a nanoporous scour (also referred to as a nanoporous scrub) can be used to remove excessive ink outside (or partially inside) the microstructures of the stamp. In this approach, a plasma-treated non-patterned CNT forest can be brought into contact against the top surface of the stamp. The CNT forest can be either coated with a hydrophilic dielectric or without coating at all. Accordingly, upon contacting the nanoporous stamp, the CNT forest can absorb the excessive ink.

Depending on the embodiment, the porosity and/or other surface features of the nanoporous scour used to remove excess ink from the nanoporous stamp can be adjusted for the application where the nanoporous stamp is being used. In some examples, the nanoporous scour may be the same or essential the same as the nanoporous stamp such that the respective porosities (and associated wicking) are the same or substantially the same. This may be achieved, for example, by fabricating the stamp and the scour at the same time and/or according to the same method, but where the scour is not patterned (and/or not patterned in the same regions such that the scour removes excess ink as required from the stamp).

In some examples, the nanoporous scour can also use electrostatic force to attract the excessive ink into the pores of the scour. In these examples, the amount of ink removed from the loaded stamp can be quantitatively controlled by the applied voltage on the scour.

In some examples, the liquid ink is made into contact with the stamp via spin coating. In these examples, after the initial loading, the stamp can be spun for an extended period of time to remove the excessive ink via centrifugal force during spinning. For example, the spinning can be performed at about 1,500 rpm for about 0.5 minutes to about 5 minutes depending on the desired amount of ink to be removed. In some examples, techniques described herein can be used in any combination.

Control the Thickness of Printed Pattern

As described above, the thickness of the printed pattern depends on the amount of ink released onto the target substrate. In one example, this thickness can be controlled by the amount of ink loaded onto the stamp. Accordingly, any of the techniques described herein to remove excessive ink can also be used to control the pattern thickness (e.g., controlling the applied voltage, using nanoporous scour, extra spinning, etc.).

In addition, the thickness of the printed pattern can be further controlled by the amount of ink released onto the target substrate during printing. The amount of ink released onto the target substrate can be similarly controlled by the applied voltage. For example, a first amount of ink can be loaded onto the stamp by applying a first voltage. During printing, the first voltage can be only partially removed (e.g., a residual voltage is maintained) and accordingly a residual amount of ink can be left on the stamp. In this case, the amount of ink actually printed can be less than the amount of loaded ink, thereby allowing further control of the layer thickness.

Furthermore, the pressure applied on the stamp against the target substrate during printing can also be used to control the amount of ink that results in the printed pattern. In general, a higher pressure force can release more ink onto the target substrate. Without being bound by any particular theory or mode of operation, there can be three regimes of such applied pressure. At lower pressure (e.g., less than 28 kPa), incomplete transfer may occur within the microstructures, i.e. less ink than desired in transferred onto the target substrate. At moderate pressure (e.g., about 28 kPa to about 150 kPa), the printed features match the stamp patterns, indicating that contact is uniform. At high pressure (e.g., greater than 150 kPa), overprinting may occur where the size of the printed features exceeds the stamp feature sizes, causing reduction of shape fidelity. High pressures may also result in excessive deformation of the nanoporous stamp surface and/or buckling of the microstructures.

Depending on the implementation, the pressure applied can be greater than about 0.5 kPa and less than about 200 kPa and/or greater than 1 kPa and less than 175 kPa. In some implementations, the pressure applied can be: about 150 kPa, about 125 kPa, about 100 kPa, about 75 kPa, about 50 kPa, about 40 kPa, about 30 kPa, about 20 kPa, about 15 kPa, about 10 kPa, about 9 kPa, about 8 kPa, about 7 kPa, about 6 kPa, about 5 kPa, about 4 kPa, about 3 kPa, about 2 kPa, or less, including any values and sub ranges in between.

Liquid Ink

In some embodiments, the ink comprises a solvent having a surface tension less than 150 mN/m, less than, 125 mN/m, less than 110 mN/m, less than 100 mN/m, less than 90 mN/m, less than 80 mN/m, less than 70 mN/m, less than 60 mN/m, or less than 50 mN/m. In some embodiments, the ink may be a colloidal ink, in some implementations, including functional nanoparticles. In some embodiments, the average pore size of a nanoporous stamp is (a) substantially larger than the average size of the functional nanoparticles of the ink and/or molecules therein.

The colloidal inks can include a variety of electronic materials. In some embodiments, the ink includes silver (Ag) nanoparticles dispersed in a solution (also referred to as a solvent). In some embodiments, the solution can include tetradecane, or $CH_3(CH_2)_{12}CH_3$. The particle concentration can be, for example, about 30 wt % to about 80 wt % (e.g., about 30 wt %, about 40 wt %, about 50 wt %, about 60 wt %, about 70 wt %, or about 80 wt %, including any values and sub ranges in between). The diameter of the silver nanoparticles can be, for example, substantially equal to or less 10 nm (e.g., about 10 nm, about 9 nm, about 8 nm, about 7 nm, about 6 nm, about 5 nm, or less, including any values and sub ranges in between).

In some embodiments, the ink includes quantum dots (QDs) dispersed in a solution. For example, the QDs can include COOH-functionalized CdSe/ZnS core-shell type QDs (i.e., a core made of CdSe surrounded by a shell made of ZnS) and the solution can include tetradecane. In some embodiments, the dispersion can be facilitated by sonication (e.g., for about 3 minutes). The particle concentration can be about 5 wt % to about 50 wt % (e.g., about 5 wt %, about 10 wt %, about 15 wt %, about 20 wt %, about 25 wt %, about 30 wt %, about 35 wt %, about 40 wt %, about 45 wt %, or about 50 wt %, including any values and sub ranges in between).

In some embodiments, the ink includes ZnO nanoparticles. In some embodiments, the ZnO nanoparticles can be doped with Aluminum (Al) (e.g, with 3.15 mole percent Al) dispersed in 2-propanol and propylene glycol. The work function of the ZnO nanoparticles can be about 4.1 eV to about 4.5 eV (e.g., 808172, from Sigma-Aldrich). The particle concentration can be, for example, about 1 wt % to about 10 wt % (e.g., about 1 wt %, about 2 wt %, about 3 wt %, about 4 wt %, about 5 wt %, about 6 wt %, about 7 wt %, about 8 wt %, about 9 wt %, or about 10 wt %, including any values and sub ranges in between). The particle size of the ZnO nanoparticles can be, for example, about 5 nm to about 20 nm (e.g., about 5 nm, about 10 nm, about 15 nm, or about 20 nm, including any values and sub ranges in between).

In some embodiments, the ink includes $WO_3$ nanoparticles, such as crystalline $WO_3$. The work function of the $WO_3$ nanoparticles can be, for example, about 5.3 eV to about 5.7 eV (e.g., 807753, from Sigma-Aldrich). The $WO_3$ nanoparticles can be dispersed in 2-propanol and propylene glycol to form the colloidal ink. The particle concentration can be, for example, about 1 wt % to about 10 wt % (e.g., about 1 wt %, about 2 wt %, about 3 wt %, about 4 wt %, about 5 wt %, about 6 wt %, about 7 wt %, about 8 wt %, about 9 wt %, or about 10 wt %, including any values and sub ranges in between). The particle size of the $WO_3$ nanoparticles can be, for example, about 5 nm to about 30 nm (e.g., 5 nm, about 10 nm, about 15 nm, about 20 nm, about 25 nm, or about 30 nm, including any values and sub ranges in between).

Resolution and Fidelity of Printing

The resolution and fidelity (e.g., edge roughness, corner radius, etc.) of the printed pattern can be affected by several factors, including the stamp preparation (e.g., CNT microstructure geometry, surface roughness, mechanical properties, print/pattern size, surface treatment, and/or the like), the inking process (i.e., loading process), the magnitude and uniformity of the contact pressure, and the amplitude of applied voltage.

According to some embodiments, functionality of the stamp results from high porosity of the stamp, where the stamp pore size (characteristic length of $d_{pore}$) is larger than the electrically functional nanoparticles to be printed ($d_{particle}$) but smaller than the stamp features ($w_{stamp}$). For some embodiments, to maintain the ink particles well dispersed within the wet stamp, the pores within the stamp can be much larger than the particles ($d_{particle} \ll d_{pore}$). To provide for uniform ink transfer relative to the size of the stamp feature (and thus the resulting printed feature), the pores can be significantly smaller than the stamp features ($d_{pores} \ll w_{stamp}$).

For example, the nanoporous stamp can have pores with 100 nm diameter and this stamp can be employed to uniformly print ink particles of about 10 nm using stamp features as small as 3 μm. In another example, the nanoporous stamp can include single-walled CNT forests having a small CNT diameter (e.g. about 1 nm to about 2 nm) and spacing (e.g., about 10 nm to about 20 nm). Accordingly, this stamp can be used for printing sub-micrometer features.

In some examples, printed features of a stamp pattern on a target substrate have an average line edge roughness of about 2 μm or less (e.g., about 2 μm, about 1 μm, about 0.5 μm, or less, including any values and sub ranges in between). In some embodiments, the nanoporous stamp and/or printing method using the same is configured such that printed features of a pattern on target substrate have a linewidth of about 20 μm or less (e.g. about 20 μm, about 15 μm, about 10 μm, about 9 μm, about 8 μm, about 7 μm, about 6 μm, about 5 μm, about 4 μm, about 3 μm, about 2 μm, about 1 μm, or less, including any values and sub ranges in between). In some embodiments, the nanoporous stamp and/or nanoporous stamp printing method is configured such that printed features of a nanoporous stamp printed pattern on target substrate have average thickness of about 150 nm or less (e.g., about 150 nm, about 125 nm, about 100 nm, about 75 nm, about 50 nm, or less, including any values and sub ranges in between). In some embodiments, printed features of the pattern on target substrate have uniform thickness with tolerance of about 50 nm or less (e.g., about 50 nm, about 40 nm, about 30 nm, about 20 nm, about 15 nm, about 10 nm, or less, including any values and sub ranges in between).

Digital Printing Using Electrostatic Nanoporous Print Stamps

Based on the capability to control the ink transfer of porous microstructures, electrostatic nanoporous stamps described herein can be configured for digital printing by selectively applying the voltage to a subset of microstructures. In this approach, a CNT array (or any other appropriate microstructure) can be grown on a thin film transistor backplane, which can apply the necessary electrical potential between selected group of CNTs (pixels) and the ink. The ink can be controlled to only wet the selected pixels and transfer ink upon contact. Therefore, arbitrary patterns can be printed in sequence using the same stamp. In other words, the electrostatic nanoporous stamp is highly reconfigurable.

Figure 6:
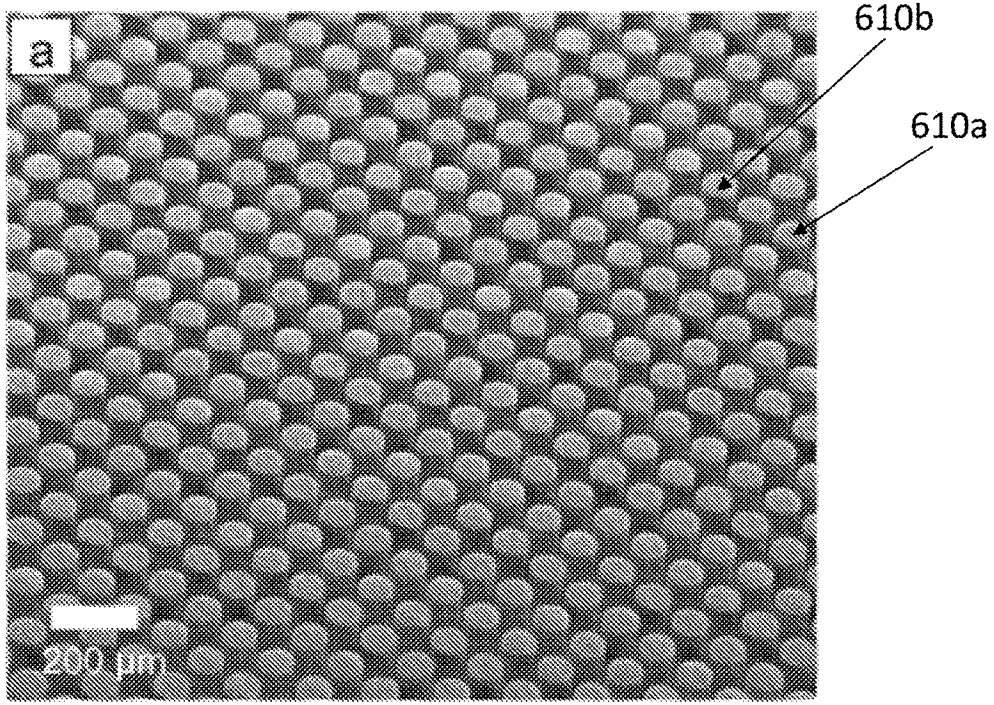
FIG. 6 is an SEM image of an electrostatic nanoporous print stamp, based on the apparatus of FIG. 1 and including an array of pixels.

FIG. 6 shows an SEM image of a CNT pillar array 600 that can be used for digital printing. Each CNT pillar (e.g., 610*a* or 610*b* labelled in FIG. 6) is disposed on a corresponding electrode that can apply a voltage on this CNT pillar and not on other CNT pillars. Accordingly, each CNT pillar can function as one pixel during printing. The diameter of each pillar can be about 10 μm to about 100 μm (e.g., about 10 μm, about 20 μm, about 30 μm, about 40 μm, about 50 μm, about 60 μm, about 70 μm, about 80 μm, about 90 μm, or about 100 μm, including any values and sub ranges in between), which corresponds to a printing resolution of about 300 dpi to about 2500 dpi. The spacing between adjacent pixels can also be about 10 μm to about 100 μm (e.g., about 10 μm, about 20 μm, about 30 μm, about 40 μm, about 50 μm, about 60 μm, about 70 μm, about 80 μm, about 90 μm, or about 100 μm, including any values and sub ranges in between).

The pillar shown in FIG. 6 has a round cross section. Other cross sectional shapes can also be used. For example, the CNT forest can have a square cross section, a rectangular cross section, a honeycomb cross section, or any other appropriate shape.

Figure 7A:
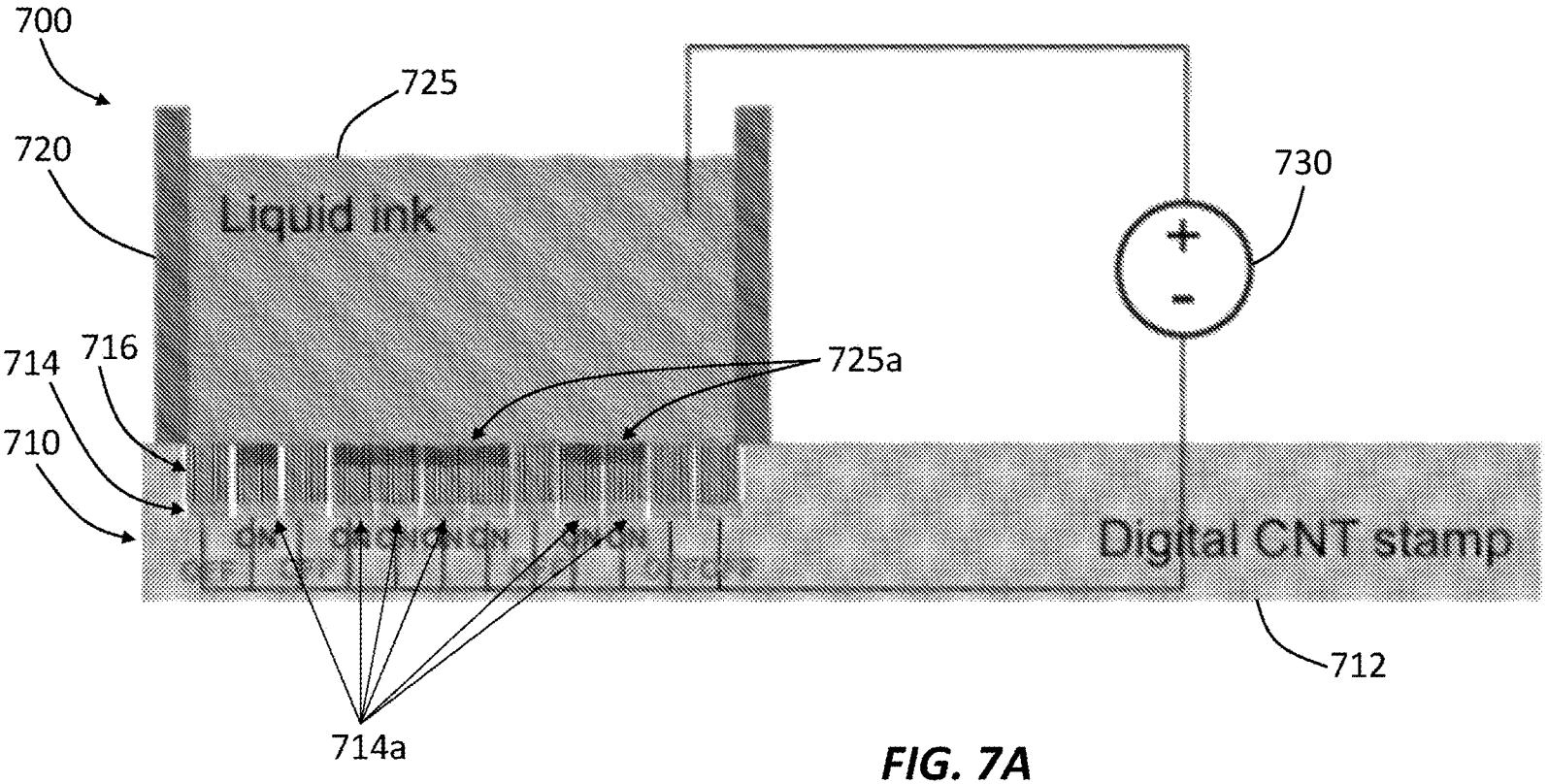
FIGS. 7A-7C illustrate a method of contact printing using the electrostatic nanoporous print stamp of FIG. 6, according to one inventive implementation.
Figure 7B:
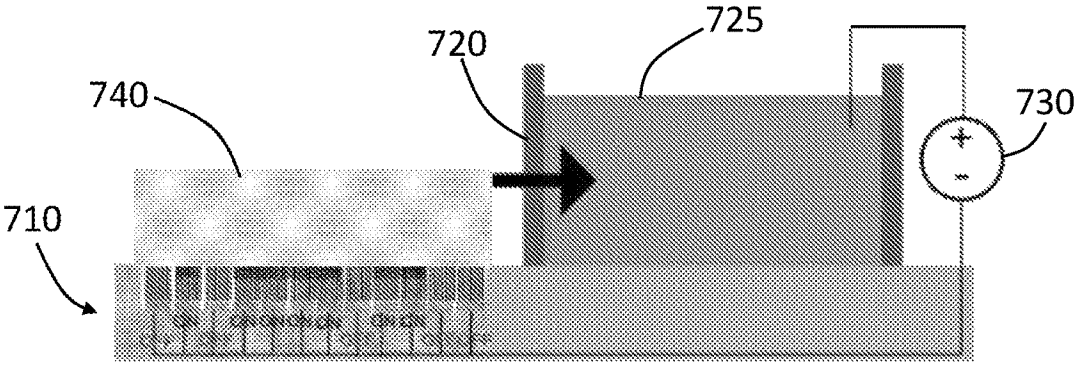
Figure 7C:
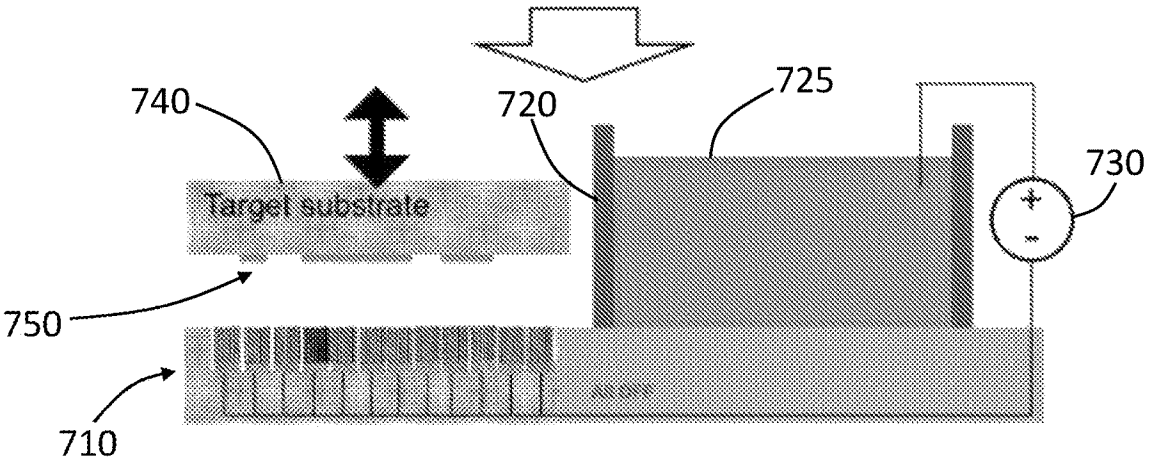

FIGS. 7A-7C illustrate a method 700 of digital printing using an electrostatic nanoporous print stamp 710. As shown in FIG. 7A, the stamp 710 includes an array of dielectric-coated CNT forests 716 (also referred to as CNT pillars 716), each of which is disposed on a corresponding electrode 714. A holder 712 is holding the array of electrodes 714 and the CNT forests 716. A vessel 720 containing a liquid ink 725 is placed on top of the CNT pillars 716. A power source 730 is used to apply a voltage between the liquid ink 725 and the stamp 710. In the method 700, each electrode has its own individual connection with the power source 730, i.e. each electrode can be connected to or disconnected from the power source 730 without affecting the connection of other electrodes (e.g., via a corresponding switch).

In FIG. 7A, a voltage is applied only on a subset of electrodes 714*a* (and accordingly those CNT pillars disposed on the electrodes 714*a*). As a result, the liquid ink 725 is only absorbed into the CNT pillars disposed on the electrodes 714*a*, resulting in a contained ink 725*a*. In contrast, CNT pillars not disposed on the electrodes 714*a* do not have electrostatic force to absorb the liquid ink 725.

In FIG. 7B, the vessel 725 is moved away from the CNT pillars 716 and a target substrate 740 is place in contact with the CNT pillars and accordingly the contained ink 725*a*. In FIG. 7C, the voltage is removed from all electrodes 714 and the target substrate 740 is lifted away from the stamp 710. The contained ink 725*a* is transferred to the target substrate 750 and forms a printed pattern 750.

After the target substrate 740 is moving away, a new voltage can be applied to another subset of electrodes in the stamp 710 to print a different pattern. This process can be repeated multiple times to take advantage of the versatility of digital printing.

Applications of Printing Using Electrostatic Nanoporous Print Stamps

The techniques of ink transfer using nanoporous stamps described herein can be used for various applications. For example, they can be used to create ultrathin, uniform printed layers for fabricating electronic devices, such as thin film transistors, where a variety of materials are deposited and patterned in spatially registered layers. In another example, the electrostatic nanoporous stamps and the associated printing methods can be utilized in printing conductive networks for transparent electrodes, as used in light-emitting diodes, liquid-crystal displays, touch-screen panels, solar cells, and numerous other devices where cost-effective fabrication of electrodes with high conductivity and transparency is desired.

Conclusion

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. An apparatus for contact printing using an ink, the apparatus comprising:

a substrate;

a conductive layer disposed on the substrate;

a plurality of microstructures disposed on the conductive layer, each microstructure including a porous medium comprising a conductive material; and a dielectric layer conformally disposed on the plurality of microstructures and configured to electrically insulate the plurality of microstructures from the ink during use.

2. The apparatus of claim 1, wherein the conductive layer includes Titanium Nitride (TiN).

3. The apparatus of claim 1, wherein the conductive layer includes a plurality of conductive electrodes, each electrode in the plurality of conductive electrodes being disposed under a corresponding microstructure in the plurality of microstructures.

4. The apparatus of claim 1, wherein each microstructure has a lateral size of about 1 μm to about 100 μm.

5. The apparatus of claim 1, wherein the porous medium includes a plurality of carbon nanotubes.

6. The apparatus of claim 1, wherein the porous medium includes a plurality of metal nanowires.

7. The apparatus of claim 1, wherein the porous medium includes a plurality of aligned carbon nanotubes.

8. The apparatus of claim 1, wherein the porous medium includes a plurality of aligned metal nanowires.

9. The apparatus of claim 1, wherein the porous medium includes a plurality of vertically aligned carbon nanotubes.

10. The apparatus of claim 1, wherein the porous medium includes a plurality of vertically aligned metal nanowires.

11. The apparatus of claim 1, wherein the porous medium has a top section having an average pore size of about 100 nm or less.

12. The apparatus of claim 1, wherein the porous medium includes a plurality of carbon nanotubes or a plurality of conductive fibers, and an average spacing between adjacent nanotubes or adjacent conductive fibers is about 100 nm or less.

13. The apparatus of claim 1, wherein the porous medium includes carbon-based aerogels, metal aerogels, or metal-oxide aerogels.

14. The apparatus of claim 1, wherein the porous medium has an average void size of about 1 nm to about 100 nm.

15. The apparatus of claim 1, wherein the dielectric layer comprises a hydrophobic material.

16. The apparatus of claim 1, wherein the dielectric layer includes a polymer or an oxide.

17. The apparatus of claim 1, wherein the dielectric layer has a thickness of about 50 nm or less.

18. A method of contact printing using a nanoporous print stamp, the method comprising:

contacting the nanoporous print stamp with an ink;

applying a voltage between a conductive layer in the nanoporous print stamp and the ink to load the ink into a dielectric-coated porous medium disposed on the conductive layer based at least in part on an electrostatic force between the nanoporous print stamp and the ink, the dielectric-coated porous medium including a conductive porous medium conformally coated with a dielectric layer;

contacting the nanoporous print stamp with a target substrate; and adjusting an amplitude of the voltage between the conductive layer and the ink to release the ink from the nanoporous print stamp and onto the target substrate so as to form a pattern.

19. The method of claim 18, further comprising:

changing the amplitude of the voltage between the conductive layer and the ink to change an amount of the ink loaded into a dielectric-coated porous medium.

20. The method of claim 18, wherein the conductive layer includes a periodic two-dimensional (2D) array of electrodes, the conductive porous medium includes a 2D array of microstructures, and each electrode in the 2D array of electrodes is disposed under a corresponding microstructure in the 2D array of microstructures.

21. The method of claim 20, wherein applying the voltage comprises applying the voltage to a subset of electrodes in the array of electrodes so as to load the ink onto a corresponding subset of microstructures in the array of microstructures, the corresponding subset of the microstructures representing a shape of the pattern.

22. The method of claim 20, wherein adjusting the amplitude of the voltage comprises removing the voltage from a subset of electrodes in the array of electrodes so as to release the ink from a corresponding subset of microstructures in the array of microstructures, the corresponding subset of the microstructures representing a shape of the pattern.

23. The method of claim 20, wherein adjusting the amplitude of the voltage comprises decreasing the voltage from a subset of electrodes in the array of electrodes so as to control the amount of ink to be transferred from a corresponding subset of microstructures in the array of microstructures to the target substrate, the corresponding subset of the microstructures representing a shape of the pattern.

24. The method of claim 20, wherein applying the voltage comprises applying a first voltage to a first subset of electrodes in the array of electrodes to print a first pattern, and the method further comprises:

applying a second voltage to a second subset of electrodes in the array of electrodes to print a second pattern different from the first pattern.

25. The method of claim 18, wherein the porous medium has a top section having an average pore size of about 100 nm or less.

26. The method of claim 18, wherein porous medium includes a plurality of carbon nanotubes.

27. The method of claim 18, wherein the dielectric layer comprises a hydrophobic material.

28. The method of claim 18, wherein the dielectric layer has a thickness of about 20 nm or less.

29. An nanoporous print stamp for contact printing using an ink, the stamp comprising:

a substrate;

an array of electrodes disposed on the substrate;

an array of microstructures, each microstructure being disposed on a corresponding electrode in the array of electrodes, each microstructure including a plurality of vertically aligned carbon nanotubes extending from the corresponding electrode, the plurality of carbon nanotubes having: (a) a top section having an average pore size of about 100 nm or less, and (b) a lateral size of about 1 μm to about 100 μm; and a dielectric layer conformally disposed on the array of microstructures and configured to electrically insulate the plurality of vertically aligned carbon nanotubes of each microstructure in the array of microstructures from the ink during use.

* * * * *